US006120242A

United States Patent [19]

Bonnoitt et al.

[11] Patent Number: 6,120,242

[45] Date of Patent: Sep. 19, 2000

[54] BLADE CONTAINING TURBINE SHROUD

[75] Inventors: Michael T. Bonnoitt; Robert P. Czachor, both of Cincinnati, Ohio

[73] Assignee: General Electric Company, Cincinnati, Ohio

[21] Appl. No.: 09/191,659

[22] Filed: Nov. 13, 1998

[51] Int. Cl.[7] ..... F01D 21/00

[52] U.S. Cl. ..... 415/9; 415/174.4; 415/200

[58] Field of Search ..... 415/9, 173.4, 174.4, 415/178, 200; 29/889.1, 402.08

[56] References Cited

U.S. PATENT DOCUMENTS 4,009,568 3/1977 King et al. .
4,127,357 11/1978 Patterson .
4,417,848 11/1983 Dembeck ..... 415/9
4,784,569 11/1988 Sidenstick et al. .
4,856,963 8/1989 Klapproth et al. .
5,160,248 11/1992 Clarke .
5,431,532 7/1995 Humke et al. ..... 415/9
5,474,417 12/1995 Privett et al. ..... 415/58.5

*Primary Examiner*—Edward K. Look
*Assistant Examiner*—Liam McDowell
*Attorney, Agent, or Firm*—Andrew C. Hess; Nathan D. Herkamp

[57] ABSTRACT

A low pressure turbine shroud includes an arcuate backsheet having opposite mounting rails for engaging a surrounding annular case. The backsheet includes a thicker blade containment shield extending between the rails in a unitary construction. And, a honeycomb rub strip is fixedly joined to the backsheet between the rails.

20 Claims, 3 Drawing Sheets

BLADE CONTAINING TURBINE SHROUD

BACKGROUND OF THE INVENTION

The present invention relates generally to gas turbine engines, and, more specifically, to blade containment therein.

A typical gas turbine engine includes in serial flow communication a fan, multistage axial compressor, combustor, high pressure turbine (HPT), and low pressure turbine (LPT). During operation, air is pressurized in the compressor and mixed with fuel and ignited in the combustor for producing combustion gases which flow downstream through the HPT and LPT which extract energy therefrom for powering the compressor and fan, respectively, through corresponding driveshafts.

The fan, compressor, and turbines each include differently configured rotor blades extending radially outwardly from corresponding rotors or disks which rotate during operation. For various reasons during the useful life of the engine, a rotor blade may fail and separate from its corresponding rotor disk. Centrifugal force will then propel or eject the liberated blade radially outwardly into its surrounding stator case. The different stator cases are configured in various manners for dissipating blade ejection energy for containing the blade and preventing its liberation from the engine.

The various rotor blades are different in size and operate at different rotary speeds and therefore have different amounts of ejection energy when liberated. The different rotor blades also require different surrounding stator cases which experience different operating environments from the relatively cool environments in the fan, compressor, and LPT, to the hottest environment in the HPT.

Since engine efficiency is maximized by minimizing the radial clearance or gap between the radially outer tips of the corresponding blades in their cases, the cases include various forms of blade shrouds surrounding the blade tips for minimizing the clearance therewith while also permitting occasional rubs therebetween without damaging the blades. In a tip rub, the blade shrouds are damaged, and when such damage accumulates, the blade shrouds are replaced in a periodic maintenance outage.

In turbine blade containment, the corresponding turbine cases are correspondingly sized in thickness for dissipating the ejection energy. In the HPT, the blade shrouds provide a significant contribution to blade containment since they are typically relatively thick, cast metal structures having substantial strength.

However, LPT blade shrouds are typically uncooled, light-weight sheet metal constructions having little, if any, significant ability for dissipating ejection energy. A typical LPT blade shroud is an assembly of a sheet metal backsheet having a light weight honeycomb rub strip attached thereto. The backsheet has forward and aft rails which are suitably mounted to corresponding forward and aft mounting hooks extending radially inwardly from the case. The backsheet is thin sheet metal, of about 20 mils thickness for example, for minimizing the weight of the shroud yet providing sufficient rigidity for being mounted to the case and maintaining a preferred clearance with the blade tips. The sheet metal may be locally thickened at one or both of the rails for providing sufficient strength for attachment to the corresponding hooks.

In some configurations, the backsheet may be too thin between its axially separated rails, and is reinforced using a doubler sheet, which is typically another thin piece of sheet metal brazed or otherwise fixedly attached to the outer side of the backsheet.

In either configuration of the LPT shroud, with or without the doubler, the blade containing capability thereof is negligible. Since the doubler, for example, is brazed to the backsheet, the brazing filler is relatively brittle and in a blade ejection event the filler is subject to brittle cracking and decreases the strength of the shroud.

Accordingly, it is desired to provide a LPT blade shroud having blade containment capability.

BRIEF SUMMARY OF THE INVENTION

A low pressure turbine shroud includes an arcuate backsheet having opposite mounting rails for engaging a surrounding annular case. The backsheet includes a thicker blade containment shield extending between the rails in a unitary construction. And, a honeycomb rub strip is fixedly joined to the backsheet between the rails.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
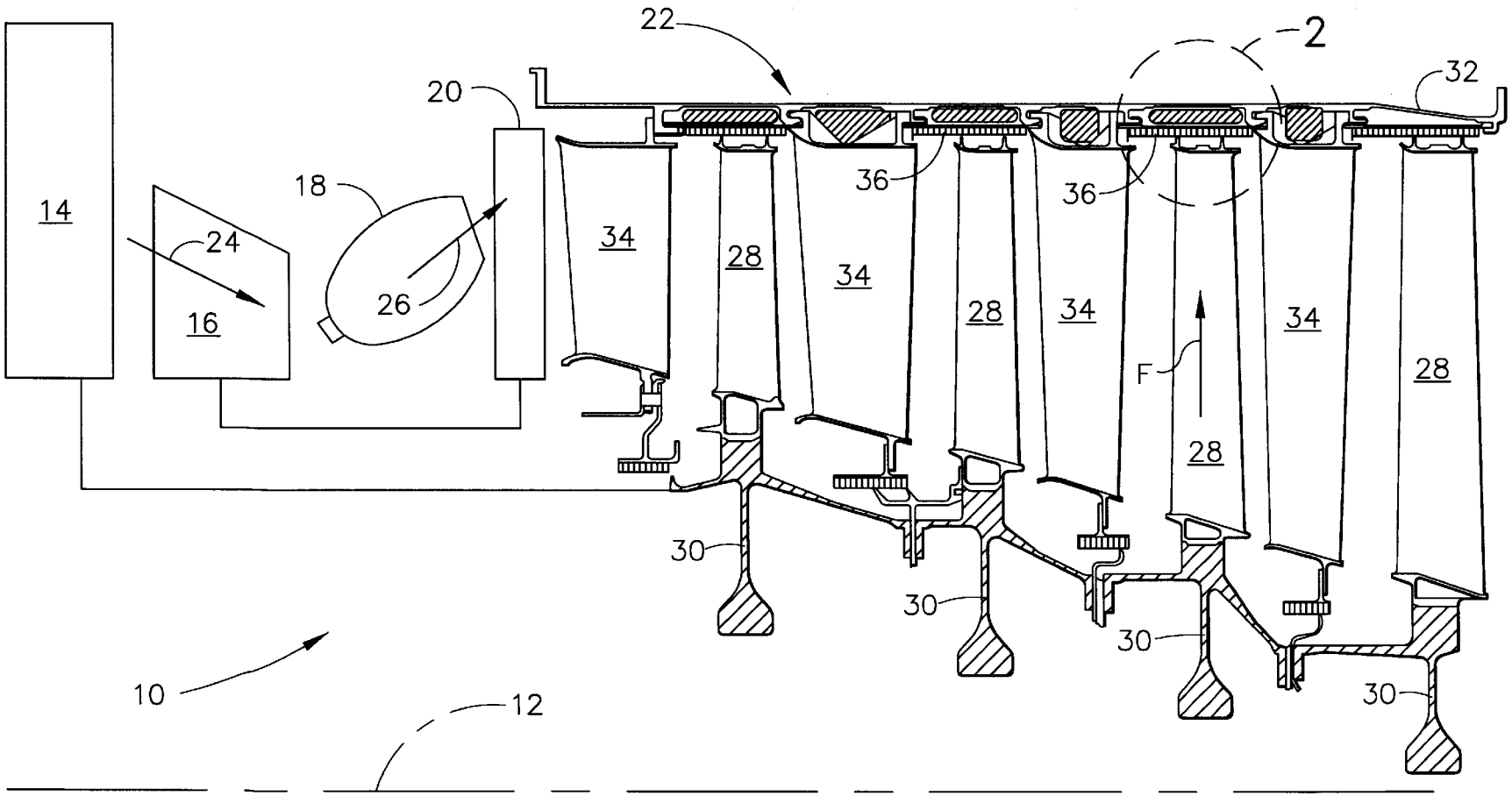
FIG. 1 is a partly schematic and elevational sectional view through an exemplary gas turbine engine including a low pressure turbine having a blade shroud in accordance with an exemplary embodiment of the present invention.

Illustrated schematically in FIG. 1 is an exemplary gas turbine engine 10 which is axisymmetrical about a longitudinal or axial centerline axis 12. The engine includes in serial flow communication a fan 14, multistage axial compressor 16, combustor 18, high pressure turbine (HPT) 20, and low pressure turbine (LPT) 22.

During operation, air 24 is pressurized in the compressor, mixed with fuel in the combustor and ignited for generating hot combustion gases 26 which flow downstream in turn through the HPT 20 and the LPT 22 which extract energy therefrom for powering the compressor 16 and fan 14, respectively. Since the combustion gases 26 have their greatest temperature upon discharge from the combustor, the HPT 20, including its rotor blades, stator vanes, and blade shrouds, is cooled using a portion of the compressed air 24 bled from the compressor during operation. Upon reaching the LPT 22, the combustion gases 26 have a reduced temperature, and the LPT is therefore typically uncooled.

The exemplary multistage LPT 22 illustrated in FIG. 1 includes several rows of rotor blades 28 extending radially outwardly from corresponding rotor disks 30 which are interconnected and joined to a common driveshaft for powering the fan 14 during operation.

The LPT also includes an annular casing or case 32 from which extends radially inwardly corresponding nozzles in the form of rows of stator vanes 34 which cooperate with corresponding ones of the blade rows for channeling the combustion gases therethrough.

In accordance with the present invention, one or more rows of LPT blade shrouds 36 are also mounted to the case 32 for surrounding a respective row of the rotor blades 28 for use in blade containment thereof in the event of a blade ejection event. As shown in FIG. 1, an exemplary one of the rotor blades 28 may fail during operation and separate from its supporting disk 30, with centrifugal force F propelling or ejecting the liberated blade radially outwardly for firstly impacting the surrounding blade shroud 36 and then impacting the surrounding case 32.

Figure 2:
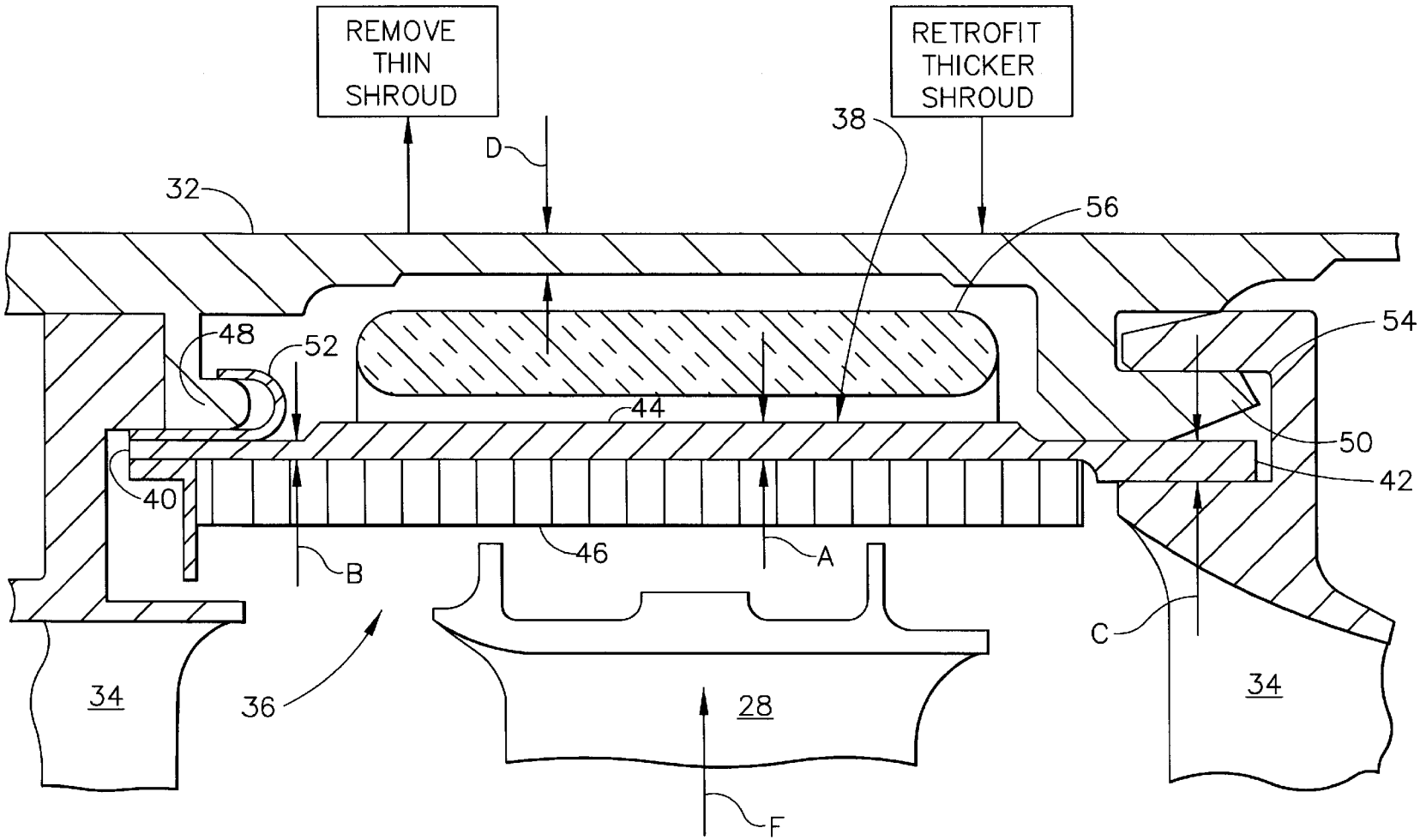
FIG. 2 is an enlarged view of a portion of the LPT blade shroud illustrated in FIG. 1 within the dashed circle labeled 2.
Figure 3:
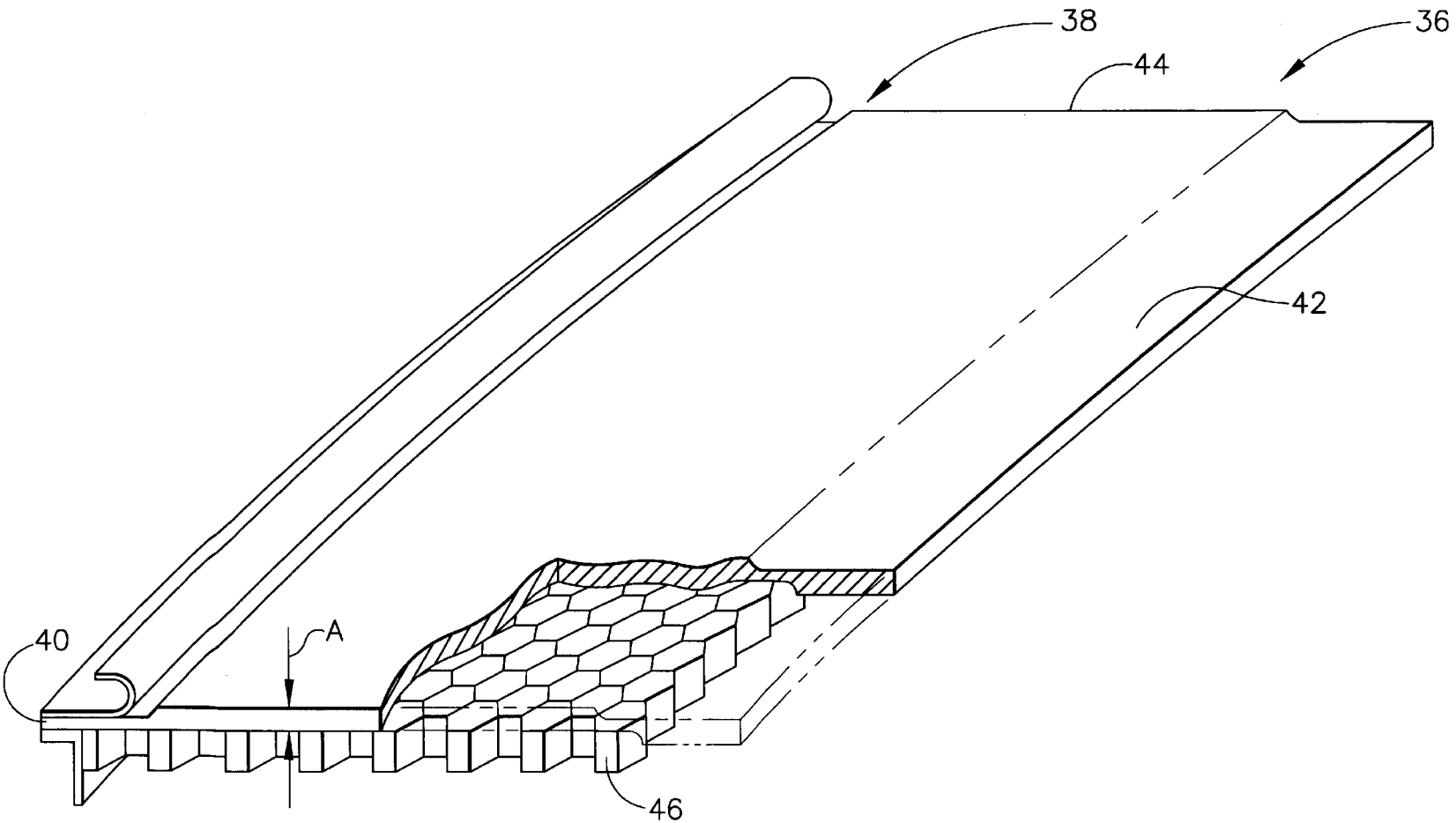
FIG. 3 is an isometric view of one of several arcuate segments of the shroud illustrated in FIG. 2 in an exemplary embodiment.

As shown in FIGS. 2 and 3, each blade shroud 36 is preferably formed in a plurality of circumferentially adjoining arcuate segments which collectively form a complete ring around the radially outer tips of a blade row. The shroud includes an arcuate backsheet 38 having a first or forward mounting rail 40 and a second or aft mounting rail 42 disposed at axially opposite ends thereof for engaging the case 32. The backsheet also includes an integral blade containment shield 44 extending axially between the two rails 40,42 in a unitary or one-piece construction. The shield portion of the backsheet is selectively thicker than each of the rails for dissipating blade ejection energy for cooperating with the case in blade containment of the ejected blade.

The blade shroud 36 also includes a honeycomb rub strip 46 fixedly joined or bonded directly to the radially inner surface of the backsheet 38 axially between the two rails 40,42. The rub strip may take any conventional form and extends the full circumferential length of each of the backsheet segments. The rub strip 46 has a suitable height so that its radially inner surface may be suitably spaced from the blade tips to provide a clearance gap therebetween.

As shown in FIG. 3, the shield 44 extends both axially between the two rails 40,42 and circumferentially therealong over the full arcuate extent of the segment for being aligned directly over the blade tips illustrated in FIG. 2. The shield is sized in thickness for dissipating energy upon ejection of one of the blades 28 thereagainst in a failure event.

In the exemplary embodiment illustrated in FIG. 3, the shield is preferably continuous axially along the rails 40,42 and circumferentially therealong, with a substantially constant thickness A. Alternatively, the shield 44 may be in the form of a plurality of axially spaced apart, circumferentially extending ribs having reduced weight while providing blade containment capability.

Since it is desirable to introduce additional blade containment capability in addition to that provided by the case 32 itself, the containment shield 44 is selectively thickened relative to the remainder of the backsheet 38 for also reducing overall weight, while effectively locating blade containment material. For example, the containment shield 44 preferably extends radially outwardly from both rails 40,42 to avoid changing the thickness of the rub strip 46. And, the radially inner surface of the backsheet 38 is preferably recessed radially outwardly from at least one of the two rails such as the aft rail 42.

In the exemplary embodiment illustrated in FIG. 2, the forward rail 40 is flush with the recessed inner surface of the shield 44 and has a minimum thickness B suitable for mounting the forward end of the shroud to the casing. Correspondingly, the aft rail 42 has a larger thickness C selected for supporting the aft end of the shroud to the case 32.

In a conventional mounting configuration, the case 32 includes integral forward and aft hooks 48,50 extending radially inwardly and axially spaced apart to engage or mount the forward and aft rails 40,42, respectively. Suitable means are provided for retaining the rails on the hooks in a locked arrangement. For example, a generally U-shaped, sheet metal forward clip 52 is attached, by brazing for example, to the top of the forward rail 40 for axially engaging the tip end of the forward hook 48. And, the aft rail 42 is attached in radial abutment against the aft hook by a corresponding generally U-shaped aft clip 54 formed at the forward end of the radially outer band of the adjacent nozzle vanes 34.

In this exemplary configuration, the aft rail 42 is thicker than the forward rail 40, and the shield 44 is thicker than the aft rail 42 as well as the forward rail 40. This configuration selectively minimizes the thicknesses B, C of the forward and aft rails 40,42 as required for mounting the shroud 36 to the corresponding case hooks 48,50, while providing a selectively thickened middle region therebetween in the form of the unitary containment shield portion.

In the preferred embodiment illustrated in FIG. 2, the backsheet 38 is a unitary or one-piece sheet metal construction formed of any suitable metal for the LPT environment, such as conventional HS 188 which is a cobalt alloy. The containment shield 44 is preferably at least thrice as thick as the forward rail 40, with the forward rail being about 20 mils thick, the aft rail 42 being about 40 mils thick, and the containment shield 44 being about 60 mils thick in one example.

Although the rails are thinner than the center shield portion of the backsheet 38, only the shield portion is disposed radially outwardly of the rotor blades 28 and is interposed between the case 32 for providing additional blade containment capability.

The improved blade containment shrouds 36 cooperate with the surrounding case 32 for collectively providing blade containment capability. In particular, the case 32 between the hooks 48,50 has a thickness D and is disposed radially outwardly of the inner shield 44, itself having a thickness A. The combined material of the shield 44 and the case 32 radially outwardly of the blades 28 collectively provide for energy dissipation of an ejected blade for blade containment thereof, and preventing liberation from the case of most if not all of the liberated blade.

As shown in FIG. 2, an annular thermal insulator 56 is disposed in the available space between the case 32 and the shield 44 for controlling thermal expansion and contraction in this region for minimizing variation in the blade tip gap during operation. The insulator, however, has negligible blade containment capability, with blade containment being primarily provided by the relatively thick case 32 and the cooperating containment shield 44.

A particular advantage of the blade containment shrouds 36 is that they may be configured in an otherwise conventional configuration except for the introduction of the selectively thickened backsheet 38 for effecting blade containment capability.

This configuration, therefore allows the retrofitting of the LPT 22 for increasing blade containment capability or strength thereof by substituting or replacing the thicker shroud 36 for a thinner conventional shroud therein without changing thickness of the case 32, and without changing geometry of the supporting hooks and remainder of the individual shrouds 36 but for the shield 44. Since turbine shrouds are normally replaced on a routine basis due to normal blade tip rubs, old-design turbine shrouds may be simply replaced with the improved blade containment shrouds 36 within the available space, and without any other changes in the shroud design.

In view of the selectively thicker backsheet 38, the use of a conventional doubler is no longer required. The thicker containment shield portion of the backsheet 38 is unitary sheet metal without brazing or other attachment for achieving the increased thickness to maximize blade containment strength without introducing any undesirable brittleness or crack initiation sites.

Furthermore, the increased thickness of the backsheet 38 does not introduce undesirable thermal gradients therein during operation which could adversely affect both aerodynamic efficiency by varying the desired radial tip clearance, or introduce undesirable thermal stresses which could affect fatigue life.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the U.S. is the invention as defined and differentiated in the following claims in which we claim:

1. A low pressure turbine shroud mountable to an annular case for surrounding a row of rotor blades, comprising:

an arcuate backsheet having forward and aft mounting rails at axially opposite ends thereof for mounting said shroud to said case, and a thicker blade containment shield extending axially therebetween in a unitary construction; and a rub strip fixedly joined to a radially inner surface of said backsheet between said rails.

2. A shroud according to claim 1 wherein said shield extends both axially between said rails and circumferentially therealong, and is sized in thickness for dissipating energy upon ejection of one of said blades thereagainst.

3. A shroud according to claim 2 wherein said shield is continuous axially between said rails and circumferentially therealong with said thickness being constant.

4. A shroud according to claim 3 wherein said shield extends radially outwardly from both said rails.

5. A shroud according to claim 4 wherein said backsheet inner surface is recessed from at least one of said rails.

6. A shroud according to claim 5 wherein said aft rail is thicker than said forward rail, and said shield is thicker than said aft rail.

7. A shroud according to claim 6 in combination with said case, with said case being sized in thickness radially outwardly of said shield for collectively providing therewith energy dissipation for said ejected blade for containment thereof.

8. A combination according to claim 7 wherein said case includes forward and aft hooks extending radially inwardly to engage said forward and aft rails, respectively, and further comprising means for retaining said rails on said hooks.

9. A combination according to claim 8 wherein said backsheet is unitary sheet metal, and said shield is at least thrice as thick as said forward rail.

10. A method of retrofitting a low pressure turbine for increasing blade containment strength thereof by substituting said thicker shroud according to claim 6 for a thinner shroud therein without changing thickness of said case.

11. A low pressure turbine shroud mountable to an annular case for surrounding a row of rotor blades, comprising:

a circumferentially arcuate segment including a backsheet having forward and aft mounting rails at axially opposite ends for mounting said shroud to said case thereof, and a thicker blade containment shield extending axially therebetween in a unitary sheet metal construction; and a rub strip fixedly joined to a radially inner surface of said backsheet between said rails.

12. A shroud according to claim 11 wherein said shield extends radially outwardly from both said rails.

13. A shroud according to claim 12 wherein said backsheet inner surface is recessed from at least one of said rails.

14. A shroud according to claim 12 wherein said aft rail is thicker than said forward rail, and said shield is thicker than said aft rail.

15. A shroud according to claim 12 wherein said shield is at least thrice as thick as said forward rail.

16. A shroud according to claim 15 wherein said shield is continuous axially between said rails and circumferentially therealong with said thickness being constant.

17. A shroud according to claim 12 further comprising a plurality of said segments circumferentially adjoining each other to collectively form a segmented ring.

18. A shroud according to claim 17 in combination with said annular case surrounding said row of turbine rotor blades, and said mounting rails are engaged in corresponding forward and aft hooks integrally formed in said case.

19. A combination according to claim 18 wherein said case is sized in thickness radially outwardly of said shield for collectively providing therewith energy dissipation for containing ejection of one said blades.

20. A method of retrofitting a low pressure turbine for increasing blade containment strength thereof by substituting said thicker shroud according to claim 12 for a thinner shroud mounted to a case therein around a row of rotor blades without changing thickness of said case.

* * * * *